United States Patent [19]

Coyle, Sr. et al.

[11] Patent Number: 4,718,314

[45] Date of Patent: Jan. 12, 1988

[54] POWER CHAIN WRENCH

[75] Inventors: William E. Coyle, Sr., Houma; Dennis J. Penisson, Raceland, both of La.

[73] Assignee: Bilco Tools, Inc., Houma, La.

[21] Appl. No.: 935,678

[22] Filed: Nov. 28, 1986

[51] Int. Cl.[4] ..... B25B 13/52

[52] U.S. Cl. ..... 81/57.33; 81/65.2; 269/131

[58] Field of Search ..... 81/57.17, 57.33, 57.16, 81/57.15, 57.18, 57.34, 57.36, 57.42, 57.43, 57.46, 74, 69, 65.2, 68, 64; 269/287, 126, 130, 131; 173/163

[56] References Cited

U.S. PATENT DOCUMENTS

| | | | |
|---|---|---|---|
| 695,480 | 3/1902 | Nordstrom | 81/57.17 |
| 823,238 | 10/1906 | Clark | 81/57.16 |
| 1,384,688 | 7/1921 | Corrigan | 81/57.16 |
| 3,805,646 | 4/1974 | Knight | 269/131 |
| 3,880,024 | 4/1975 | Asada | 81/57.34 |

FOREIGN PATENT DOCUMENTS

| | | | |
|---|---|---|---|
| 2515089 | 4/1983 | France | 81/65.2 |

*Primary Examiner*—Frederick R. Schmidt
*Assistant Examiner*—Bradley I. Vaught
*Attorney, Agent, or Firm*—Charles W. Fallow; Martin P. Hoffman; Mitchell B. Wasson

[57] ABSTRACT

Disclosed herein is a power tongs, including a rotary head and a circular plate loosely mounted on the head, with a flexible member secured at one end to the plate. The flexible member is wrapped around the pipe to be torqued and the free end of the member is tensioned around the pipe by means of a lever that is pivotally supported on the plate, the lever having an outwardly extending arm that is engaged by a pin extending upward from the rotary head as the tongs are operated. The flexible member distributes radial loads over the surface of the pipe to prevent crushing of the pipe and damage to its surface.

6 Claims, 4 Drawing Figures

FIG. 3.
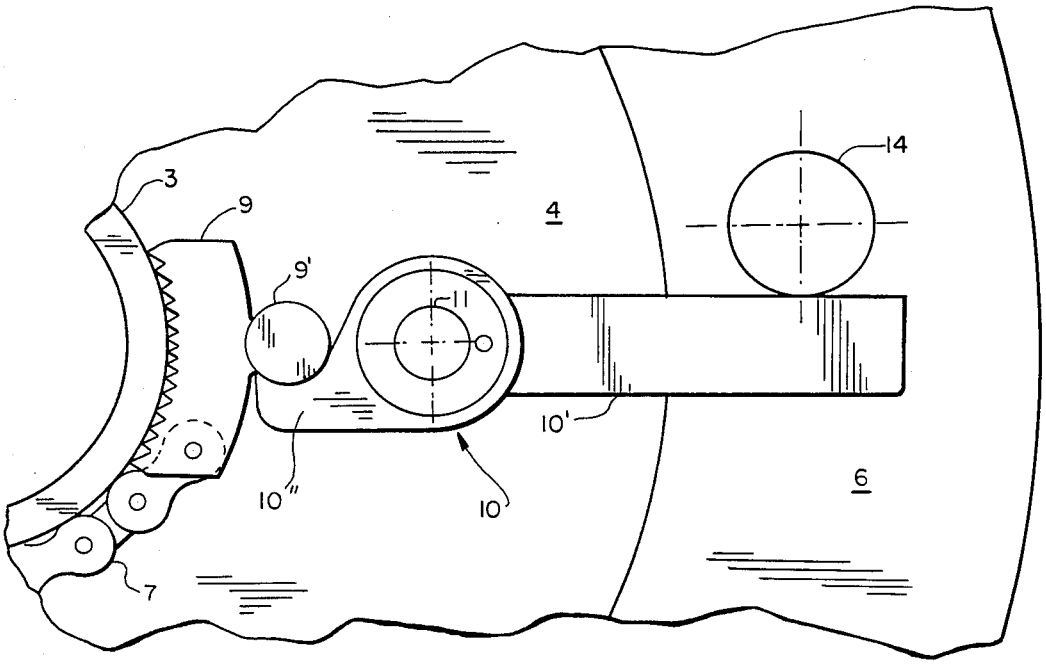
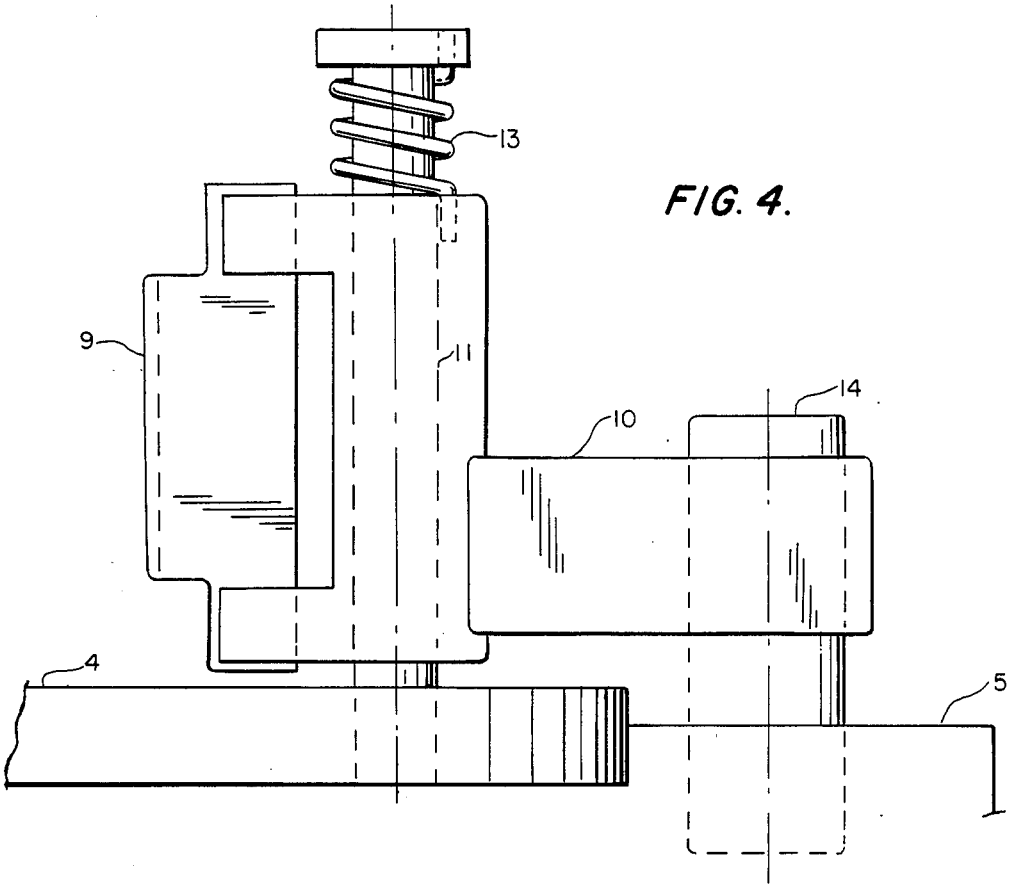
FIG. 4.

POWER CHAIN WRENCH

BACKGROUND OF THE INVENTION

This invention relates to the art of power wrenches and more particularly to a mechanism for gripping fiberglass pipe as it is rotated by power tongs.

The prior art contains many diverse jaw constructions for power tongs, most of which include jaws having serrated faces designed to bite into the surface of a pipe and means for applying radially inward force to the jaws as the power tongs operates. As a consequence, most prior art tongs' jaws cause substantial damage to the surface on the pipe upon which they are used. With standard pipe materials, this is ordinarily not a problem; however, with particularly soft materials, it may be, and the inventors have already proposed a power tongs jaw construction designed to avoid surface damage. That invention is disclosed in U.S. patent application Ser. No. 886,195 filed July 9, 1986 which is incorporated herein by reference. That application is intended particularly for soft metallic pipes. Modern non-metallic well pipe, for example fiberglass pipe which is manufactured by winding layers of fiberglass and plastic to form a tube, presents an entirely different set of problems, and it is this type of pipe to which the present invention is directed.

If traditional cam actuated toothed jaws are used on fiberglass pipe, too much pressure is concentrated at the points where the jaws contact the pipe, and this can cause the plastic and fiberglass layers to crack and separate.

It is therefore an object of this invention to spread out the gripping pressure over the entire circumference of the pipe and this object is achieved by using a chain or strap wrench to apply torque to the pipe.

A second object of the invention is to avoid causing surface damage to the fiberglass pipe by eliminating the need for toothed dies.

These and other objects are achieved by the present invention, which comprises in combination a power tong having a rotating head, a plate for mounting concentrically upon said head, means for rotatably retaining said plate upon said head, a post extending vertically from said plate, a flexible member having two ends, one of which is attached to said post and the other of which has engagement means thereon, said flexible element being of sufficient length to encircle a pipe of a predetermined diameter which is to be rotated by the tongs, a pin extending vertically from said plate, a lever pivotally mounted upon said pin, said lever having two ends on opposite sides of said pin, one of said ends comprising a finger adapted to contact said engagement means on the flexible element and the other end of said lever forming an actuating arm, and a rod extending vertically from said rotating head, said rod being positioned to engage the actuating arm of said lever.

BRIEF DESCRIPTION OF THE DRAWINGS

An embodiment of the invention is shown in the accompanying drawings wherein:

FIG. 3 shows a portion of a portion of FIG. 1 in greater detail, and

FIG. 4 is a front elevational view of a portion of FIG. 3.

DESCRIPTION OF THE PREFERRED EMBODIMENT

Figure 1:
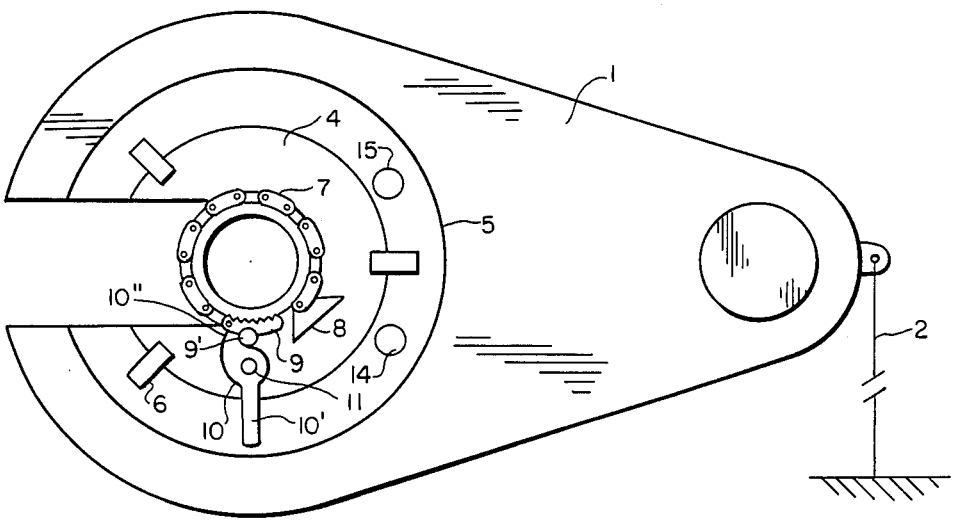
FIG. 1 shows a top plan view of the invention.
Figure 2:
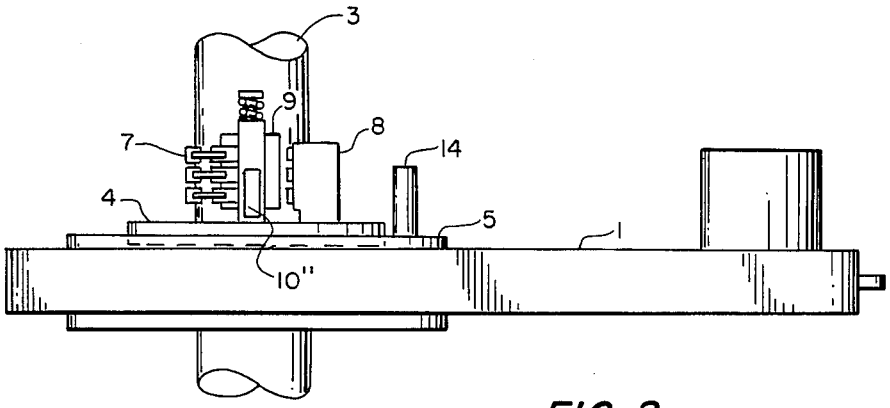
FIG. 2 shows a side elevational view thereof.

The present invention is embodied in a power tongs shown in FIGS. 1 and 2. As shown, the power tongs, designated generally by the numeral 1, is itself restrained against rotation by a snub line shown diagramatically as 2. The tongs has a rotary head 5 with a side opening therein to receive a fiberglass well pipe 3. A circular plate 4 also having a side opening to admit the pipe is set in a corresponding depression cut in the rotary head 5 and is retained therein by clips 6 which are loosely fitted to allow the plate 4 to rotate with respect to the rotary head. A vertical post 8 is securely affixed to the plate 4, as by welding, and extends upwardly therefrom.

One end of a multi-strand chain 7 is attached to the post and the other end is wrapped around the pipe 3 as shown in FIG. 1. The free end of the chain 7 has a toothed die 9 attached thereto; means thereon such as a pin 9' allow the die to be engaged at its outer face. The means for engaging this pin comprise a lever 10 pivotally mounted on a shaft 11 that extends vertically upward from the plate 4. The lever has an outer end forming a generally radially extending arm 10' and an inwardly facing finger or pawl 10" for engaging the pin 9' on the jaw 9 as shown in FIG. 1. The lever 10 is ordinarily biased in the clockwise direction by a torsion spring 13 shown in FIG. 4, which lightly preloads the chain. Referring again to FIG. 1, note the rod 14 extending upwardly from the rotary head 5 in such a position that its path carries it into engagement with the arm 10' of lever 10. Numeral 15 designates the position of a similar rod that may be used for counterclockwise torquing.

In operation, the side opening of the plate 4 and rotary head 5 are placed over the pipe so that the pipe is now centered within the rotary head. The chain is then wrapped counterclockwise around the pipe so that the die 9 engages the outer surface of the pipe near the post 8. The lever 10, which has been moved out of the way, to the right in FIG. 1 while wrapping the chain around the pipe, is now released and the torsion spring 13 causes the finger 10" to engage the pin 9' on the die and thus lightly preload the chain 7. The preload also brings the teeth of the die into contact with the periphery of the pipe.

Now, starting from the position shown in FIG. 1, the tongs' motor is activated by means (not shown) and this causes the head 5 to rotate in a clockwise direction while any reaction movement on the part of the tongs is prevented by the snub line 2. Since the plate 4 is only loosely mounted on the rotary head, no substantial torque is delivered to the pipe during the initial portion of the rotary head's movement. However, when the rod 14 reaches the lever arm 10', and this is shown in detail in FIG. 3, the entire force generated by the rotary head is delivered to the arm 10 and then via the finger 10" and the pin 9' to the die 9 thus tightening the chain 7. The tangential force may be large, but as will be apparent, no radially inward force is applied at any point other than that resulting from chain tension and this is distributed around the entire circumference of the pipe. Since the rotary head in moving in the clockwise direction, greater tension is exerted on that end of the chain 7 which is attached to the post 8 than at the end attached to the die 9. Once the position of FIG. 3 is reached, no further movement of the rotary head 5 can occur without corresponding rotation of the plate 4 and chain 10 which carry with them the pipe 3 and rotate the same until a desired make-up torque is reached.

The tongs may be advantageously be controlled by various devices owned and manufactured by Bilco Tools, Inc. as described and shown in U.S. Pat. Nos. 4,552,041 and 4,579,024, which allow one to control very precisely the effective mke-up torque level.

In certain applications, it may be appropriate and preferable to replace the multi-length chain 7 with a flexible band or strap for distributing the pressure on the pipe while transferring the torque from the rotary head to the pipe.

Inasmuch as these and other modifications of the invention will occur to one of ordinary skill in the art, it is intended that the foregoing description shall be interpreted only as illustrative of the invention, whose full scope is set out in the following claims.

We claim:

1. A power chain wrench for a power tongs having a rotating head, comprising in combination a plate for mounting concentrically upon said head, means for rotatably retaining said plate upon said head, a post extending vertically from said plate, a flexible member having two ends, said flexible element being of sufficient length to encircle a pipe of a predetermined diameter which is to be rotated by the tongs, one of said ends being attached to said post and the other end thereof having means for engaging the exterior of said pipe, a pin extending vertically from said plate, a lever pivotally mounted upon said pin, said lever having two ends on opposite sides of said pin, one of said ends comprising a finger adapted to contact said engagement means on the flexible element and the other end of said lever forming an actuating arm, and a rod extending vertically from said rotating head, said rod being positioned to engage the actuating arm of said lever.

2. The invention of claim 1 wherein said flexible member comprises at least one link chain.

3. The invention of claim 1 wherein said flexible member comprises at least three chains in parallel.

4. The invention of claim 3 wherein each of said chains comprises a plurality of links and each link has a concave inner surface of radius substantially identical to that of the pipe to be torqued.

5. The invention of claim 1 wherein said flexible member is a flexible strap.

6. The invention of claim 1 wherein said engaging means comprises a die having a toothed inner surface.

* * * * *